US007992618B2

(12) United States Patent
Narita

(10) Patent No.: US 7,992,618 B2
(45) Date of Patent: Aug. 9, 2011

(54) COATING-FILM TRANSFER TOOL

(75) Inventor: Yasuo Narita, Tokyo (JP)

(73) Assignee: Plus Stationery Corporation, Tokyo (JP)

( * ) Notice: Subject to any disclaimer, the term of this patent is extended or adjusted under 35 U.S.C. 154(b) by 335 days.

(21) Appl. No.: 12/292,601

(22) Filed: Nov. 21, 2008

(65) Prior Publication Data

US 2009/0185849 A1 Jul. 23, 2009

(30) Foreign Application Priority Data

Jan. 18, 2008 (JP) ..... 2008-009738

(51) Int. Cl.
*B32B 37/26* (2006.01)
*B26F 3/02* (2006.01)
*B43L 19/00* (2006.01)

(52) U.S. Cl. ..... 156/577; 156/527; 156/579; 118/767; 118/200; 118/257; 242/588; 242/588.3; 242/588.6; 242/160.2; 242/160.4; 242/170; 242/171; 206/411

(58) Field of Classification Search ..... 156/574, 156/577, 523, 527, 538, 579; 118/76, 200, 118/257; 225/46; 206/411; 242/160.2, 160.4, 242/170, 171, 588, 588.2, 588.3, 588.6
See application file for complete search history.

(56) References Cited

U.S. PATENT DOCUMENTS

| | | | | |
|---|---|---|---|---|
| 5,379,477 | A | 1/1995 | Tamai et al. | |
| 6,260,599 | B1 * | 7/2001 | You | 156/577 |
| 6,601,631 | B1 * | 8/2003 | Miller et al. | 156/577 |
| 2003/0034133 | A1 * | 2/2003 | Huthmacher | 156/577 |

FOREIGN PATENT DOCUMENTS

| | | | |
|---|---|---|---|
| EP | 0 987 208 | A1 | 3/2000 |
| EP | 1 273 544 | A1 | 1/2003 |
| EP | 1 359 107 | A2 | 11/2003 |
| EP | 1 522 514 | A1 | 4/2005 |
| JP | H7-13860 | | 3/1995 |
| JP | 2006-001236 | | 1/2006 |
| JP | 2006-281495 | | 10/2006 |
| JP | 2006-281496 | | 10/2006 |
| WO | WO-01/62648 | | 8/2001 |

OTHER PUBLICATIONS

Singapore Search and Examination Report dated Jan. 8, 2010, issued in Singapore Patent Application No. 200809230-6.
European Search Report dated Jun. 3, 2009 issued in EP08 17 0783.8.

* cited by examiner

*Primary Examiner* — Mark A Osele
(74) *Attorney, Agent, or Firm* — Edwards Angell Palmer & Dodge LLP

(57) ABSTRACT

A coating-film transfer tool is configured to positively absorb rotation of a head part caused when pressed and an effect of lean of the head part, and such a configuration contributes to favorable and uniform transfer. A member 4 is disposed at one end of a support column 2 supporting a head part 1 at the other end. A distance between the axial center of the support column 2 and its periphery varies depending on a position in the rotation direction. Sandwiching plates 3 resiliently sandwich the facing sides of the member 4 with the narrowest gap, when the head part 1 is not pressing a transfer target. When the head part 1 rotates around the axis of the support column 2 in a state pressing the transfer target, the member 4 rotates to forcibly and significantly widen the gap between the sandwiching plates and generate a restoring force.

6 Claims, 6 Drawing Sheets

COATING-FILM TRANSFER TOOL

BACKGROUND OF THE INVENTION

1. Field of the Invention

The present invention relates to a coating-film transfer tool (referred to as a coating-film transfer tool, a coating tool, etc., but typically referred to as a "coating-film transfer tool") that sends out a transfer tape having a transfer layer (a tape-like layer coated with glue, a tape-like layer coated with a film for correcting characters, etc.) and that adheres the transfer layer to a transfer target (e.g., paper). When an operator holds a coating-film transfer tool in hand, presses a transfer tape to a transfer target with a head part, and transfers while moving, the head part may rotate (or incline) around the axis of the head part or may lean (incline) in a direction opposite to a moving direction, depending on how a pressing force is applied. Therefore, in response to such a case, the present invention specifically relates to a coating-film transfer tool capable of uniformly transferring.

2. Description of the Related Art

In general, when the operator presses and moves a head part of a coating-film transfer tool to transfer only a certain distance, there is a case where a force is not applied evenly in a direction of the width (a direction orthogonal to a moving direction) of a transfer tape, part thereof is pressed (i.e., a rotation force is caused in the width direction), and a transfer layer is transferred unevenly. Moreover, in a case where the coating-film transfer tool is pressed while being moved by a distance desired to be transferred, a pressing force varies (i.e., how the head part leans in the direction opposite to the moving direction varies) depending on the distance or the pressing operator, and therefore, it may be impossible to uniformly transfer.

Japanese Unexamined Utility Model Application Publication No. 07-13860 describes a technique for absorbing the rotation force by sandwiching the front end of a crimping blade of the head part as described above.

In the technique of Japanese Unexamined Utility Model Application Publication No. 07-13860, the crimping blade is simply held so as to be rotatable by a holder extending from a case wall.

Although rotating in accordance with movement of the crimping blade of the head part, the holder does not have a restoring force for returning the crimping blade to its original position with respect to the case. In this technique, since the head part continues rotating once rotated, it is necessary to manually return the head part to its original position, and it is considerably troublesome to handle.

Further, Japanese Unexamined Patent Application Publication No. 2006-1236 describes a technique in which the lower portion of the head part is formed into a convex spherical shape in a direction orthogonal to the axial direction of the head part and the case has a concave spherical surface to receive the convex spherical portion and make it fit therein. Rotation (rotation around the axis of a support column of a head) and lean (inclination in a direction orthogonal to a direction of the width of the head) caused by pressure received by the head in use are absorbed by rotation of the convex spherical portion within the concave spherical surface. A resin support column supporting the head part or a coil spring provides the restoring force.

However, Japanese Unexamined Patent Application Publication No. 2006-1236 also proposes a configuration in which the case has a thin plate instead of the convex spherical surface. The reason for elimination of limitation by the concave spherical surface is that it is insufficient to handle only by movement of the convex spherical surface within the concave spherical surface, depending on the pressing force received by the head part. Thus, in this technique, a complex force by combination of rotation and lean caused by the pressing force applied on the head part is converted into the rotation of the convex spherical surface within the concave spherical surface. However, since only the support column supporting the head or the spring, whose roots are fixed, provides the restoring force with respect to the pressing force, it is difficult to set and regulate a proper restoring force with respect to the complex pressing force with such a configuration. In this point, the coil spring is considered to be advantageous in providing the restoring force with respect to the complex pressing force because the coil spring can deform with high flexibility. However, in the case of using the coil spring, it is difficult to set and regulate a resilient force because of a force to jump out in a direction of the axial length or a compression force.

SUMMARY OF THE INVENTION

The present invention has been devised to improve the abovementioned problem, and an object thereof is to provide a coating-film transfer tool that facilitates favorable transfer and uniform transfer with a configuration to absorb rotation of a head part caused in a pressed state and return the head part to the normal position and additionally with a configuration to positively absorbing the influence of lean of the head part.

In order to solve the abovementioned problem, in a first mode of the present invention, a coating-film transfer tool comprises: an unwinding part configured to send out a transfer tape provided with a transfer layer on one surface thereof; a transfer part, having a head part configured to transfer the transfer layer by moving the sent-out transfer tape while pressing against a transfer target and a support column configured to support the head part at one end thereof; a winding part configured to wind up the tape after transfer; and a case configured to house the unwinding part, the transfer part and the winding part, the case having a window for making the head part of the transfer part protrude therefrom, wherein there are provided: a member disposed at the other end of the support column of the transfer part, a distance of the member from the center of an axis of the support column to the periphery of the member varying in accordance with a position in a rotation direction; and a resilient sandwiching mechanism disposed inside the case and configured to resiliently sandwich two opposing sides of the member, an interval of the two opposing sides being the narrowest, when the head part is not pressing the transfer target.

Further, in a second mode of the present invention, the coating-film transfer tool of the first mode is characterized in that, when the head part rotates around the axis of the support column while pressing the transfer target, the member rotates to forcibly and significantly widen an interval of the resilient sandwiching mechanism sandwiching the two opposing sides of the member from the narrowest interval and to cause a restoring force.

Further, in a third mode of the present invention, the coating-film transfer tool of the second mode is characterized in that the support column is formed so that the other end is thinner than the one end and a cross-section of the other end has a rectangular or oval shape because the other end serves as the member, and two sides of the rectangular or oval shape, between which the interval is the narrowest, are sandwiched by the resilient sandwiching mechanism.

Further, in a fourth mode of the present invention, the coating-film transfer tool of the fourth mode is characterized in that: a window frame of the case forming the window has a circular inner periphery; there are provided a ring configured to be rotatable along the inner periphery of the window frame, the support column of the transfer part being inserted into the ring, and a shaft member bridged from a direction orthogonal to a movement direction of the tape near the center of the ring; and the shaft member keeps the support column of the transfer part inserted into the ring at a constant position with respect to the ring, and the support column is supported so as to be rotatable together with the ring around the axis of the shaft member.

Further, in a fifth mode of the present invention, the coating-film transfer tool of the fourth mode is characterized in that the support column has resilience to incline the head part in the movement direction of the transfer tape in accordance with a pressing condition when the head part is pressed while moving in a transfer direction and to cause the restoring force.

Further, in a sixth mode of the present invention, the coating-film transfer tool of the second mode further comprises: a ring fixedly disposed to a window frame of the case and provided with a circular part having a circular inner periphery at least across a specified angular range about a center axis on a side orthogonal to a movement direction of the transfer tape; a rotation guide disposed between the head part and the support column and configured to guide rotation of the head part along the inner periphery of the circular part of the ring; and stoppers disposed at border positions of the specified angular range of the inner periphery of the ring and configured to lock the rotation guide to restrict rotation of the head part beyond the specified angular range.

According to the first or second mode of the present invention, even though the head is inclined or pressed obliquely or curvedly on the surface of paper depending on how the operator holds the case, the member enables the head part to rotate accompanying a rotation force applied in the pressed state as described above, and a force to restore to the original position is applied in response to increase of the amount of rotation, whereby it is possible to absorb the rotation force of the head part and uniformly transfer. According to the fourth and sixth modes of the present invention, when the force to rotate the head part works in the pressed state, the head part rotates at a specified position (e.g., at the center) within the ring, and further rotates around the axial part, it is possible to minimize variations in transfer state, thereby facilitating uniform transfer. According to the sixth mode, the head part inclines and restores in accordance with a leaning force generated in a pressed and moved state, so that it is possible to regulate the force of the lean, thereby facilitating uniform transfer. Furthermore, according to the fifth aspect of the present invention, it is possible to regulate the rotation range of the head part, so that it is possible to regulate excessive rotation and prevent damages.

DETAILED DESCRIPTION OF THE PREFERRED EMBODIMENTS

Figure 1:
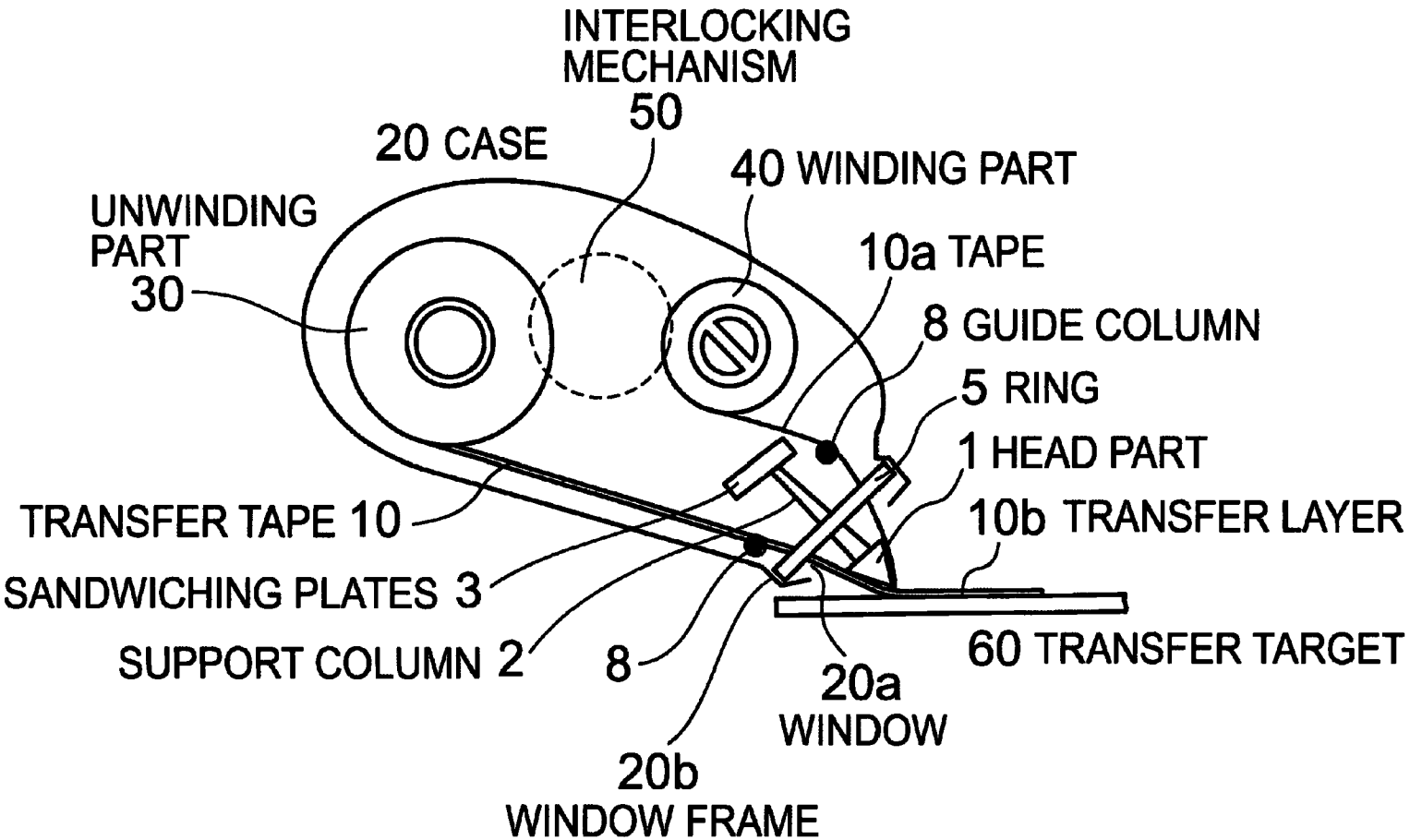
FIG. 1 is a view illustrating the entire structure of an example of a first embodiment.

Embodiments of a coating-film transfer tool of the present invention will be described with reference to the drawings. FIG. 1 is a view illustrating the entire structure of an example of a first embodiment. FIG. 2 is a view for explaining a structure supporting a head part. FIG. 3 is a view for explaining a rotation structure of the head part. FIG. 4 is a view for explaining a leaning structure of the head part. FIG. 5 is a perspective view of the appearance of another example of the first embodiment. FIG. 6 is a view illustrating the structure of the head part of a second embodiment.

First Embodiment

FIG. 1 shows a state in which the operator is transferring a transfer layer 10*b* while pressing a head part 1 against a transfer target 60 (e.g., paper) and moving the head part 1 toward the operator (leftward in FIG. 1). A case 20 shown in FIG. 1 is molded of a transparent resin. A transfer tape 10 is previously wound around an unwinding part 30 in the case 20. The transfer tape 10 is composed of a tape 10*a* and the transfer layer 10*b* that are adhered to each other. The transfer tape 10 is passed through a ring 5 via one of guide columns 8 to be put over the head part 1, and passed in the ring 5 again to be wound up by a winding part 40 via the other guide column 8. The transfer layer 10*b* is transferred to the transfer target 60 at the head part 1, and only the residual tape 10*a* is wound up by the winding part 40. The unwinding part 30 and the winding part 40 are rotated in directions opposite to each other at almost the same timings by an interlocking mechanism 50. There is a time lag in interlock between the unwinding part 30 and the winding part 40. Thus, the transfer tape 10 (the tape 10*a*) is kept in the tense state.

The head part 1 is supported by a support column 2 in a state protruding through a window 20*a* of the case. The support column 2 is rotatably sandwiched by sandwiching plates 3 at an end on the opposite side to the head part 1, and rotatably supported by the ring 5 near the head part 1.

Figure 2A:
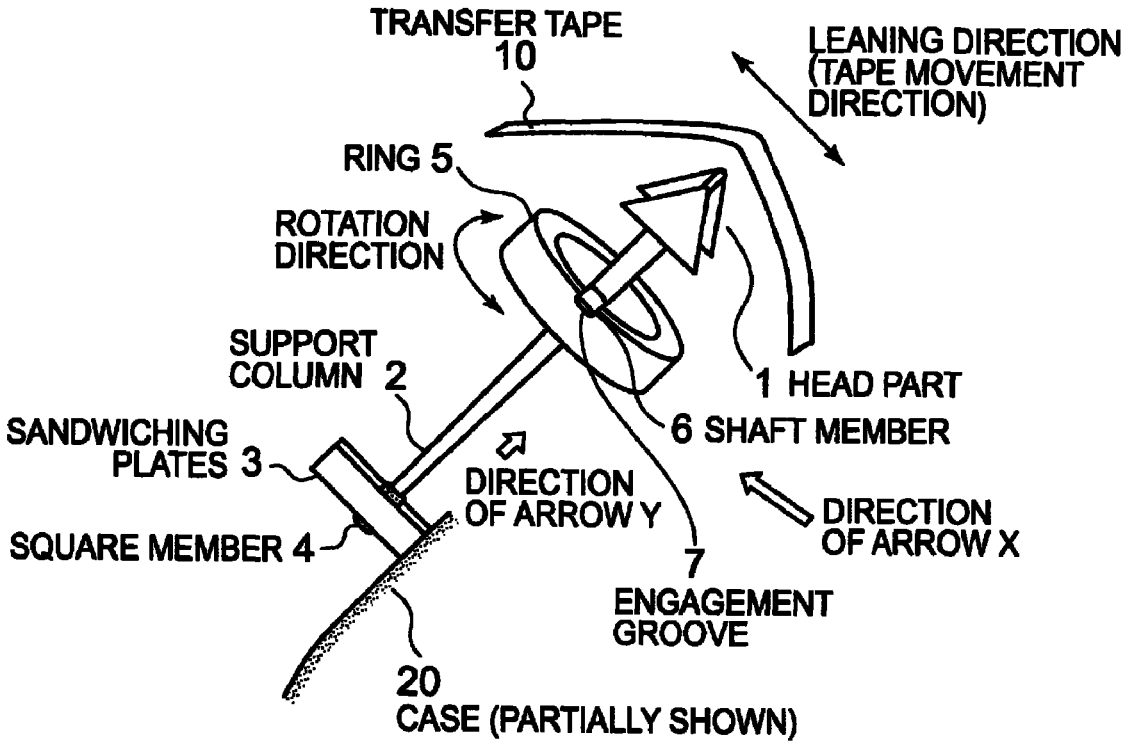
FIGS. 2A through 2C are views for explaining a structure that supports a head part.
Figure 2B:
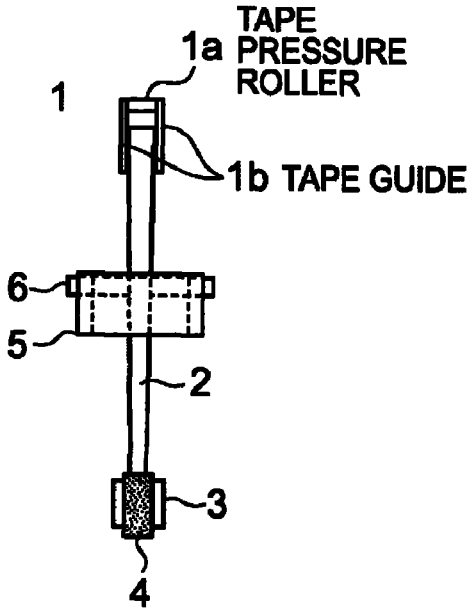
Figure 2C:
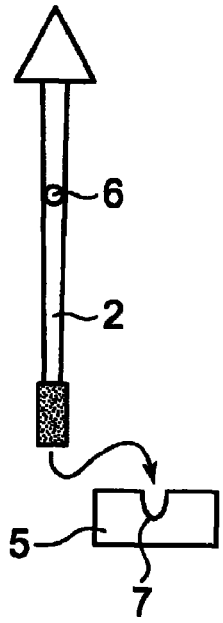

The detailed structure of the head part 1 and a surrounding mechanism engaged with the head part 1 is shown in FIGS. 2A through 2C. FIG. 2A is a perspective view of the head part 1, FIG. 2B is a view taken from a direction of an arrow X of FIG. 2A, and FIG. 2C is a view taken from a direction of an arrow Y of FIG. 2A. All of the views are schematic ones.

As shown in FIG. 2A and FIG. 2B, the head part 1 is disposed to one end of the support column 2, and a square member 4 is disposed to the other end thereof as a member whose distance between the center of the axis of the support column 2 and its periphery varies depending on a position in a rotation direction. Across the support column 2, the head part 1 has tape guides 1*b*, each of which has a shape of a substantially triangular plate. On the tops of the tape guides, a tape pressure roller 1*a* is stretched. The tape pressure roller 1*a* is formed into a columnar shape so that the transfer tape 10 is stretched to run smoothly. The tape pressure roller 1*a* may be configured not to rotate, or may be configured to be rotatable in the movement direction of the transfer tape 10. The length of the tape pressure roller 1*a* (the distance between the tape guides 1*b*) is almost the same as or longer than the width of the transfer tape 10. Both the tape guides 1*b* have the shape of a substantially triangular plate widening toward the unwinding part 30 and the winding part 40. The widening parts have a function of guiding the transfer tape 10 (the tape 10*a*) running from the unwinding part 30 to the winding part 40 so as not to depart from the tape pressure roller 1*a* in the direction of the length thereof.

As shown in FIG. 2B and FIG. 2C, a columnar shaft member 6 whose length direction is a direction orthogonal to the movement direction of the transfer tape 10 (i.e., a direction identical to the axial direction of the tape pressure roller 1*a*) is disposed at a position closer to the head part 1 from the center position of the support column 2. As shown in FIG. 2C, when the support column 2 is inserted into the ring 5 with the square member 4 first, both ends of the shaft member 6 fit into engagement grooves 7 of the ring 5, whereby the shaft member 6 is bridged at the center of the ring 5. FIG. 2A and FIG. 2B show a state in which the shaft member 6 fits into the engagement grooves 7. As shown in FIG. 1, the ring 5 is attached within a window frame 20*b* of the case 20, and supported so as to be rotatable along the periphery of the window frame 20*b*. The support column 2 and the square member 4 are separately provided for the convenience of explanation of the functions thereof, but it is more effective to configure so that the other end of the support column 2 works as the square member 4.

The square member 4 attached to the other end of the support column 2 is sandwiched by the pair of sandwiching plates 3 (a resilient sandwiching mechanism) attached to the case 20. In normal, the sandwiching plates 3 sandwich the square member 4 (the member) at the opposing sides between which a distance is the shortest.

Figure 3A:
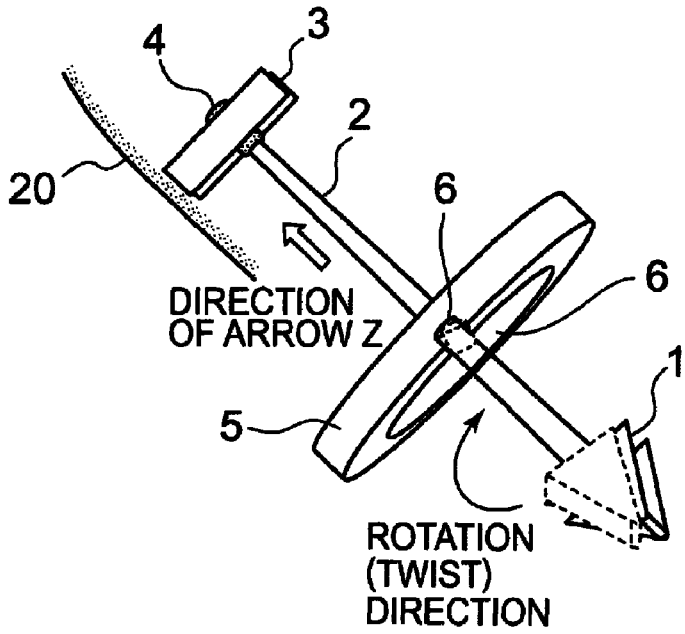
FIGS. 3A through 3D are views for explaining the mechanism of rotation of the head part.
Figure 3B:
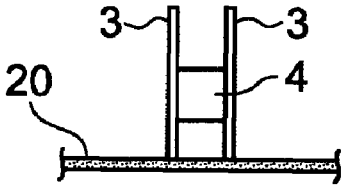
Figure 3C:
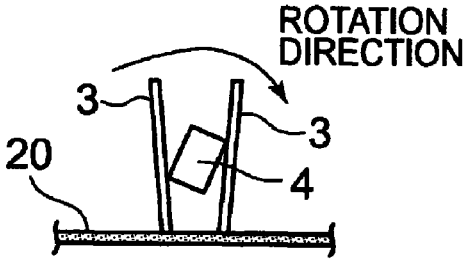
Figure 3D:
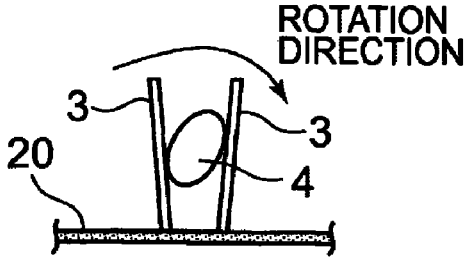

FIGS. 3A through 3D are views for explaining a state in which the head part 1 is rotated. FIG. 3A is an overall view of the head part 1 and the surrounding mechanism. FIGS. 3B, 3C and 3D are views taken from a direction of an arrow Z. FIGS. 3B and 3C show a case in which a member having a rectangular cross-section is used as the square member 4, which is a member having a noncircular cross-section, and FIG. 3D shows an example in which a member having an oval cross-section is used. In FIG. 3A, when the head part 1 is pressed and rotated from a state shown with a solid line to a state shown with a dotted line, the support column 2 rotates while twisting. The rotation of the support column 2 causes rotation of the ring 5 via the shaft member 6. That is, the support column 2 and the ring 5 rotate together. Contrarily, the ring 5 and the shaft member 6 restrict the center position of the rotation of the support column 2 so that the support column 2 rotates in the center position of the ring or at the center of the window frame 20*b* of the case 20. In other words, the ring 5 and the shaft member 6 (i.e., a support mechanism of the support column 2) absorb the rotation by positively assisting the rotation of the head part 1, and restrict the rotation position to narrowly limit and stabilize the range of wobbling of the support column 2 due to the rotation.

On the other hand, when the head part 1 is not rotating, as shown in FIG. 3B, the opposing sides with a narrower interval of the square member 4 disposed to the other end of the support column 2 are sandwiched in close contact with the pair of resilient sandwiching plates 3. When the head part 1 rotates, as shown in FIGS. 3B and 3C, the rotation force is transmitted to the sandwiching plates 3 from the corners of the square member 4, and the interval between the pair of resilient sandwiching plates 3 is increased. However, if the rotation further continues, the interval between the sandwiching plates 3 is increased, whereas a force for returning the rotation is increased by a resilient reacting force of the sandwiching plates 3. Even if a member having an oval cross-section as shown in FIG. 3D is used instead of the square member 4, a similar effect is produced. Since the rotation of the head part 1 is an abnormal condition even if the rotation is positively absorbed by the ring 5 and the shaft member 6 as described above, the square member 4 and the sandwiching plates 3 work to restore to a normal condition. Not only the sandwiching plates 3 have resilience, but also the support column 2 may have resilience to the rotational direction. For this, it is desirable to mold the support column 2 of a resin material. Moreover, it is also possible to provide the support column 2 with resilience by forming the support column 2 larger on the side of the head part 1 and thinner on the side of the square member 4.

Figure 4A:
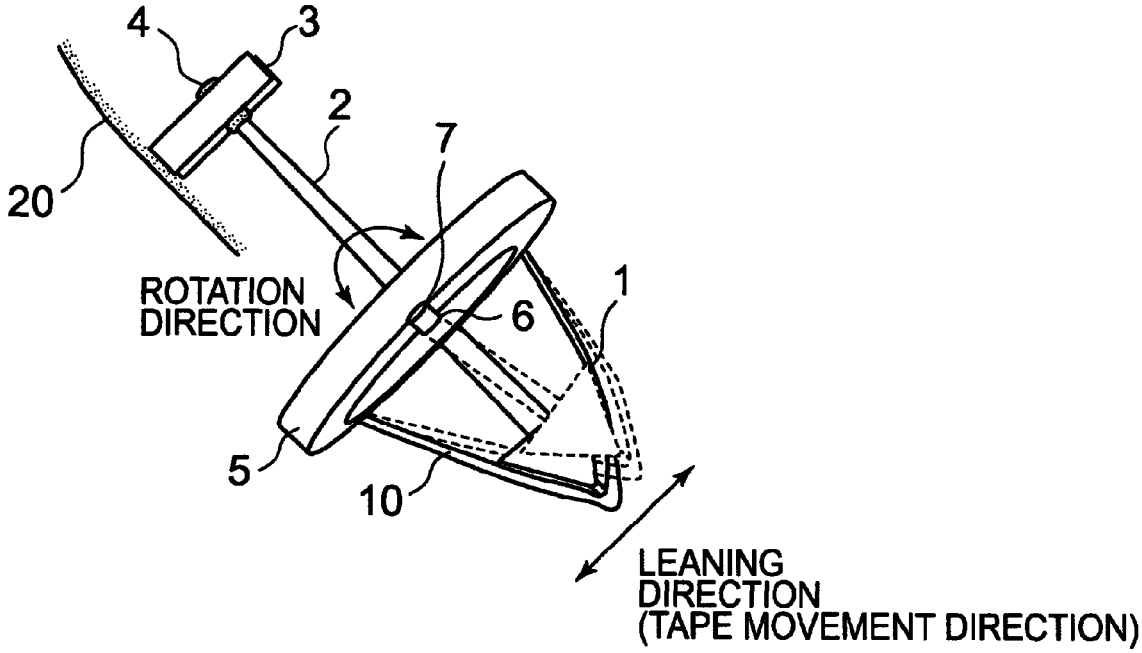
FIGS. 4A and 4B are views for explaining the structure of lean of the head part.
Figure 4B:
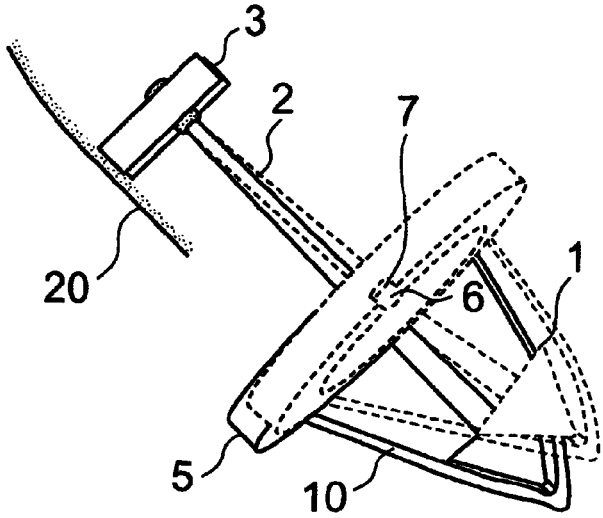
Figure 5:
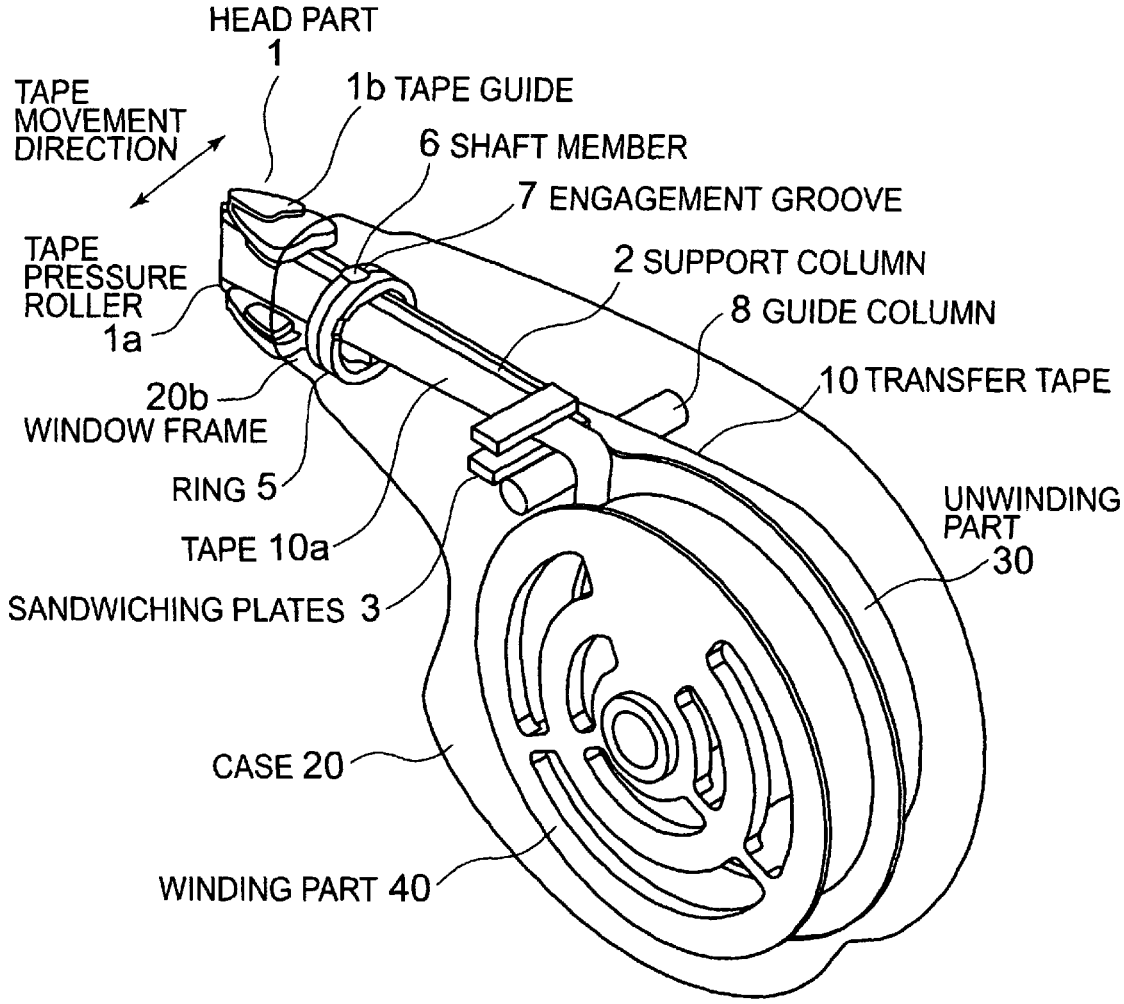
FIG. 5 is a perspective view of the appearance of another example of the first embodiment.

FIGS. 4A and 4B are views for explaining a state in which the head part 1 leans in a direction of movement of the transfer tape 10.

The lean is likely to occur because of variation in pressing force when the operator moves the head part 1 in the tape movement direction. FIG. 4A shows a case in which there is little gap between the ring 5 and the window frame 20*b*. A lean range when the head part 1 leans from a state shown with a solid line to a state shown with a dotted line in FIG. 4A depends on a length between the shaft member 6 and the head part of the support column 2 and resilience of the support column 2, because the head part 1 takes the shaft member 6 disposed in the course of the support column 2 as the fulcrum and rotates (inclines) around the axial center. Then, within the lean range, the rotation (inclination) positively absorbs the lean by taking the shaft member 6 as the origin, and at the same time, a restoring force works due to the resilience of the support column 2. FIG. 4B shows a case in which there is a large gap between the ring 5 and the window frame 20*b*. In this case, a lean range when the head part 1 leans from a state shown with a solid line to a state shown with a dotted line in FIGS. 4A and 4B depends on the length and resilience of the support column 2, because the head part 1 takes a portion sandwiched by the sandwiching plates 3 as the fulcrum and rotates (inclines) together with the ring 5. Then, within the lean range, the rotation positively absorbs the lean, and at the same time, a restoring force works due to the resilience of the support column 2.

On the other hand, accompanying the lean of the head part 1, a portion of the support column 2 between the shaft member 6 and the square member 4 in the length direction is ready to rotate (incline) around the position of the shaft member 6 or the sandwiching plates 3.

However, since both the sides of the square member 4 are sandwiched by the resilient sandwiching plates 3, the square member 4 receives a reacting force due to the resilience from the sandwiching plates 3 and is ready to return to its original position. Thus, also regarding the lean, the square member 4 and the sandwiching plates 3 work with the resilience of the support column 2 to positively absorb the lean of the support column 2 and the head part 1 and return the head part 1 to a normal state.

In a case where the aforementioned sandwiching plates 3 are composed of a pair of plate members, the sandwiching plates 3 are placed upright on the inner wall of the case 20 along the tape movement direction at the head part 1, because the gap between the pair of sandwiching plates 3 on the one end may change as shown in FIGS. 3C and 3D.

In other words, to briefly rephrase the above explanation, the following may be stated. Specifically, in this configuration, a complex pressing force received by the head part 1 in use is divided into rotation of the ring 5 (rotation around the axis of the head part 1) and rotation (inclination) around the shaft member 6, and conveyed to the support column 2. Therefore, for applying a restoring force via the support column 2, it is possible to separately regulate a restoring force against the rotation of the ring 5 (rotation around the axis of the head part 1) and a restoring force against the rotation (inclination) around the shaft member 6, though it is impossible to completely separate.

Another Example of First Embodiment

FIG. 5 shows an appearance perspective view schematically showing another example of the coating-film transfer tool. In the embodiment shown in FIG. 1, the operator transfers by pulling the coating-film transfer tool toward the operator while pressing it. On the other hand, in the example shown in FIG. 5, the operator transfers by moving the coating-film transfer tool from left to right while pressing it.

As in FIG. 1, the case 20 in FIG. 5 is molded of a transparent resin.

In FIG. 5, members denoted by the same reference numerals as in FIG. 1 have the same basic functions as in FIG. 1, though they may have slightly different shapes. In FIG. 5, the unwinding part 30 and the winding part 40 are configured to have a coaxial structure so as to be interlocked.

Because of the relationship of the rotation direction of the tape pressure roller 1*a* (i.e., the tape movement direction) and the winding direction of the winding part 40 disposed in this example, the tape 10*a* is flown so as to be twisted by 90 degrees by the guide column 8 between the tape pressure roller 1*a* and the winding part 40 in FIG. 5 and then wound up.

The mechanisms and operations other than the aforementioned are the same as in FIG. 1. However, according to the example shown in FIG. 5, the operator moves the coating-film transfer tool from left to right, so that it is easy to visually recognize how the transfer layer 10*b* is being transferred. Therefore, it is easy to visually recognize whether the way of pressing affects the transfer or not, so that the operator can easily regulate distribution of the pressing force when recognizing an adverse effect.

Second Embodiment

Figure 6A:
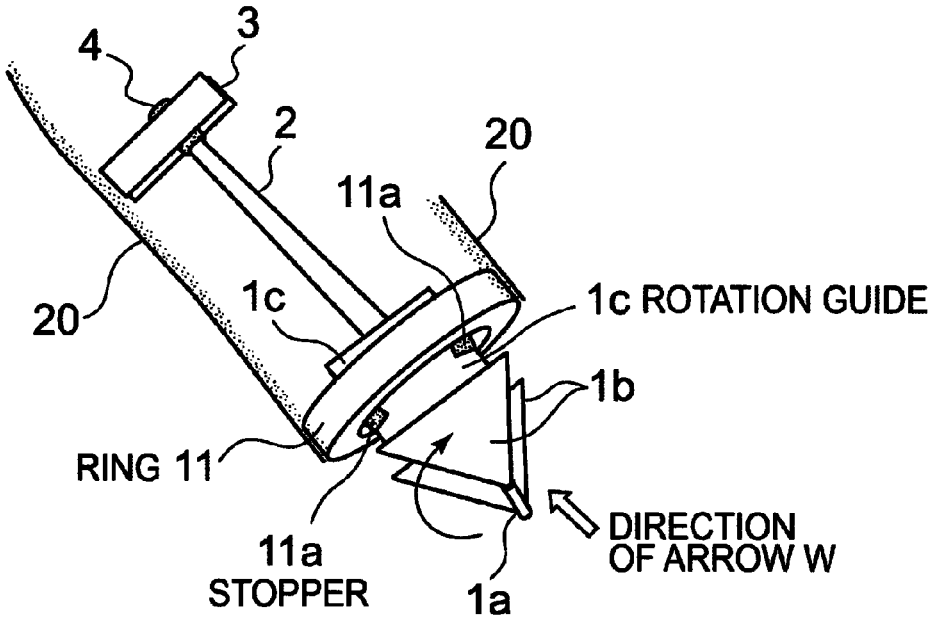
FIGS. 6A through 6C are views illustrating the structure of the head part of a second embodiment.
Figure 6B:
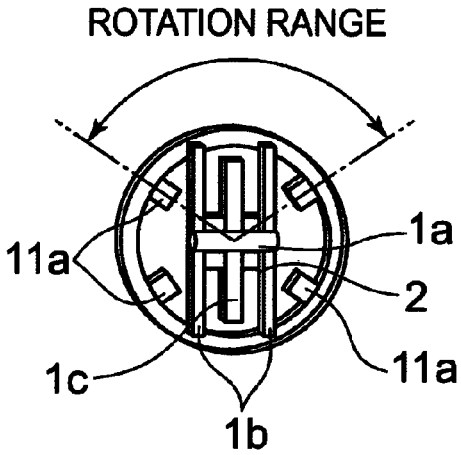
Figure 6C:
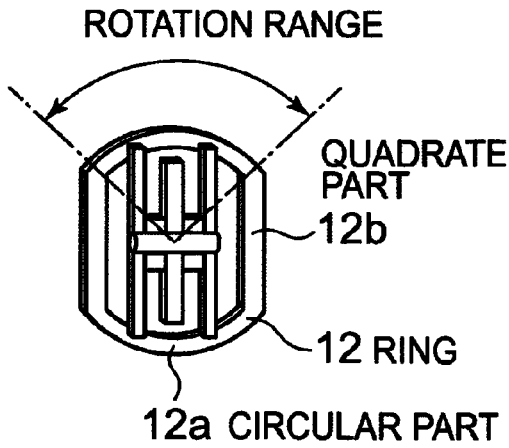

In comparison with the first embodiment and the other example thereof, a coating-film transfer tool of a second embodiment is characterized in that, as shown in FIGS. 6A through 6C, a ring 11 located around the head part 1 is fixedly disposed to the case 20. A rotation guide 1*c* configured to guide rotation of the head part 1 along the inner periphery of the ring 11 is disposed between the head part 1 and the support column 2. Stoppers 11*a* configured to restrict the range of rotation of the rotation guide 1*c* is provided within the ring 11.

In FIGS. 6A through 6C, elements denoted by the same reference numerals as in FIG. 1 and FIG. 5 have the same functions as in FIGS. 1 and 5. FIGS. 6A through 6C shows only the head part 1 and ring 11 and the vicinities thereof, and other elements may be adopted from FIG. 1 and FIG. 5, so a description thereof is omitted herein.

In FIG. 6A, the ring 11 is fixed to the case 20 so as to not rotate. It is possible to use the window frame 20*b* in FIG. 1 as the ring 11 instead of separately producing it. In FIG. 6A, between the tape guide 1*b* and the support column 2, a rotation guide 1*c* having a plate like shape whose center is fixed to the center of the support column 2 and whose radius is shorter than the radius of the ring 11 is provided. FIG. 6B is a view taken from a direction of an arrow W of FIG. 6A. As shown in FIG. 6B, when the head part 1 is ready to rotate around the axial center (i.e., the axial center of the support column 2) in a pressed state, the rotation guide 1*c* guides the rotation of the head part 1 along the inner periphery of the ring 11. That is, the rotation guide 1*c* is for restricting the rotational center of the head part 1 to approximately the center of the ring. Moreover, as in the first embodiment, in response to the rotation of the head part 1, the support column 2, square member 4 and sandwiching plates 3 absorb the rotating force to apply the restoring force. The head part 1 can lean within a range that the head part 1 can swing within the ring 11, by taking the square member 4 sandwiched by the sandwiching plates 3 as the fulcrum.

The stoppers 11*a* are provided in four locations on the inner periphery of the ring 11. When the head part 1 rotates and the rotation guide 1*c* rotates significantly, the stoppers 11*a* lock the rotation guide 1*c* so as to stop the rotation. The distance between the tip position in the direction of the center of the ring 11 of the stopper 11*a* and the center position of the ring is shorter than the radius of the rotation guide 1*c*. Therefore, as shown in FIG. 6B, the rotation range of the rotation guide 1*c* is restricted by the stoppers 11*a*.

FIG. 6C shows a ring 12 that restricts the rotation range of the rotation guide 1*c* by the shape thereof. The ring 12 may also be modified to work as the window frame 20*b*. In the configuration shown in FIG. 6C, the cross-section of the ring 12 is divided into circular parts 12*a* obtained by forming sides facing across the plane direction of the rotation guide 1*c* into a circular shape and quadrate parts 12*b* obtained by forming sides therebetween into straight lines. The distance from the rotation center of the ring 12 to the circular part 12*a* is longer than the radius of the rotation guide 1*c*, and the distance from the rotation center of the ring 12 to the quadrate part 12*b* is shorter than the radius of the rotation guide 1*c*. Therefore, the rotation of the rotation guide 1*c* is stopped at the quadrate parts 12*b*. In other words, the rotation range is restricted within the range of the circular parts 12*a*.

The components common in the configurations shown in FIGS. 6B and 6C are: the ring 12 (11) fixed to the window frame 20*b* of the case 20 and provided with the circular parts 12*a* (or part of the ring 11) having a circular inner periphery over a specified angular range (the aforementioned rotation range) at least from the center shaft; the rotation guide 1*c* disposed between the head part 1 and the support column 2 to guide the rotation of the head part 1 along the inner periphery of the circular part 12*a* of the ring 12; and the stoppers 11*a* (the quadrature parts 12*b*) disposed at the border positions of the specified angular range of the inner periphery of the ring 12, to lock the rotation guide 1*c* and restrict the rotation of the head part 1 beyond the specified angular range.

In the second embodiment with the aforementioned configuration, when the head part 1 rotates in the pressed state, the head part 1 is made to rotate around the center of the ring 11 so that uniform transfer is achieved. Moreover, the head part 1 is inhibited from excessively rotating, and thereby being protected from damage, etc.

The ring 5 rotates within the window frame 20*b* in the first embodiment and the other example thereof. However, instead of the relation between the ring 5 and the window frame 20*b*, a locking structure formed by the rotation guide 1*c* and the ring 11 (or 12) of the second embodiment also produce similar effects.

What is claimed is:

1. A coating-film transfer tool, comprising:

an unwinding part configured to send out a transfer tape provided with a transfer layer on one surface thereof;

a transfer part, having a head part configured to transfer the transfer layer by moving the sent-out transfer tape while pressing against a transfer target and a support column configured to support the head part at one end thereof;

a winding part configured to wind up the tape after transfer; and a case configured to house the unwinding part, the transfer part and the winding part, the case having a window for making the head part of the transfer part protrude therefrom, wherein there are provided:

a member disposed at the other end of the support column of the transfer part, a distance of the member from the center of an axis of the support column to the periphery of the member varying in accordance with a position in a rotation direction; and a resilient sandwiching mechanism disposed inside the case and configured to resiliently sandwich two opposing sides of the member, an interval of the two opposing sides being the narrowest, when the head part is not pressing the transfer target.

2. The coating-film transfer tool according to claim 1, wherein, when the head part rotates around the axis of the support column while pressing the transfer target, the member rotates to forcibly and significantly widen an interval of the resilient sandwiching mechanism sandwiching the two opposing sides of the member from the narrowest interval and to cause a restoring force.

3. The coating-film transfer tool according to claim 2, wherein the support column is formed so that the other end is thinner than the one end and a cross-section of the other end has a rectangular or oval shape because the other end serves as the member, and two sides of the rectangular or oval shape, between which the interval is the narrowest, are sandwiched by the resilient sandwiching mechanism.

4. The coating-film transfer tool according to claim 2, wherein:

a window frame of the case forming the window has a circular inner periphery;

there are provided:

a ring configured to be rotatable along the inner periphery of the window frame, the support column of the transfer part being inserted into the ring; and a shaft member bridged from a direction orthogonal to a movement direction of the tape near the center of the ring; and the shaft member keeps the support column of the transfer part inserted into the ring at a constant position with respect to the ring, and the support column is supported so as to be rotatable together with the ring around the axis of the shaft member.

5. The coating-film transfer tool according to claim 4, wherein the support column has resilience to incline the head part in the movement direction of the transfer tape in accordance with a pressing condition when the head part is pressed while moving in a transfer direction and to cause the restoring force.

6. The coating-film transfer tool according to claim 2, further comprising:

a ring fixedly disposed to a window frame of the case and provided with a circular part having a circular inner periphery at least across a specified angular range about a center axis on a side orthogonal to a movement direction of the transfer tape;

a rotation guide disposed between the head part and the support column and configured to guide rotation of the head part along the inner periphery of the circular part of the ring; and stoppers disposed at border positions of the specified angular range of the inner periphery of the ring and configured to lock the rotation guide to restrict rotation of the head part beyond the specified angular range.

* * * * *